US007140353B1

(12) United States Patent
Rauznitz et al.

(10) Patent No.: US 7,140,353 B1
(45) Date of Patent: Nov. 28, 2006

(54) FUEL INJECTOR WITH PIEZOELECTRIC ACTUATOR PRELOAD

(75) Inventors: Peter Rauznitz, Columbus, IN (US); David L. Buchanan, Westport, IN (US); Lester L. Peters, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 11/167,556

(22) Filed: Jun. 28, 2005

(51) Int. Cl.
*F02M 51/06* (2006.01)
*B05B 3/00* (2006.01)
*F02M 47/02* (2006.01)

(52) U.S. Cl. ..... 123/446; 239/102.2; 239/533.2

(58) Field of Classification Search ..... 123/299, 123/300, 445, 446, 447, 467, 490, 498, 506; 239/102.1, 102.2, 522.1, 533.2, 88, 584, 239/585.1, 585.4, 585.5; 310/328, 341; 251/129.06
See application file for complete search history.

(56) References Cited

U.S. PATENT DOCUMENTS

| | | | | |
|---|---|---|---|---|
| 5,320,278 | A * | 6/1994 | Kolarik et al. | 123/446 |
| 5,441,028 | A | 8/1995 | Felhofer | |
| 5,605,134 | A | 2/1997 | Martin | |
| 5,819,704 | A | 10/1998 | Tarr et al. | |
| 5,890,571 | A | 4/1999 | Sadow | |
| 6,298,829 | B1 * | 10/2001 | Welch et al. | 123/467 |
| 6,390,385 | B1 * | 5/2002 | Hardy et al. | 239/102.2 |
| 6,575,139 | B1 * | 6/2003 | Rodriguez-Amaya et al. | 123/467 |
| 6,598,811 | B1 * | 7/2003 | Boecking | 239/533.2 |
| 6,616,062 | B1 | 9/2003 | Boecking | |
| 6,644,280 | B1 * | 11/2003 | Rodriguez-Amaya et al. | 123/446 |
| 6,715,695 | B1 | 4/2004 | Lorraine | |
| 6,719,266 | B1 * | 4/2004 | Waterfield | 251/129.06 |
| 6,776,354 | B1 * | 8/2004 | Cooke | 239/102.2 |
| 6,837,221 | B1 | 1/2005 | Crofts et al. | |
| 6,978,770 | B1 * | 12/2005 | Rauznitz et al. | 123/498 |
| 2002/0056761 | A1 * | 5/2002 | Boecking | 239/88 |
| 2006/0150954 | A1 * | 7/2006 | Moore | 123/446 |

FOREIGN PATENT DOCUMENTS

| | | | | |
|---|---|---|---|---|
| DE | 19954023 | A1 * | 5/2000 | 123/446 |

OTHER PUBLICATIONS

J. Hlousek et al, "Common Rail System for Large Diesel Engines", pp. 1-5.
Siemens VDO Automotive AG, "High pressure for top form, Siemens VDO Automotive presents 3rd generation piezo diesel injection", For the trade press, Vienna, May 16, 2003.
Bosch Fuel Injection, "Injection Hurtles Forward", Automotive Industries, Nov. 2003, pp. 33-35.
Accumulator diesel injection systems, "Piezo injector for passenger cars with Common Rail System", BOSCH.
"Next-generation common rail injector steps up the pressure", Jun. 2003, p. 62.

* cited by examiner

*Primary Examiner*—Willis R. Wolfe, Jr.
(74) *Attorney, Agent, or Firm*—Tim L. Brackett, Jr.; Nixon Peabody LLP

(57) ABSTRACT

An piezoelectric actuated injector is provided which includes a nozzle valve element, a control volume, and an injection control valve including a control valve member for controlling fuel flow from the control volume so as to control nozzle valve movement. Importantly, the injector includes a preload chamber positioned along an injection control valve member for receiving high pressure fuel. The high pressure fuel acts on the injection control valve member to apply a preload force to supply a preload force to the stack of piezoelectric elements thereby ensuring more accurate control over fuel injection timing and metering.

20 Claims, 3 Drawing Sheets

FUEL INJECTOR WITH PIEZOELECTRIC ACTUATOR PRELOAD

TECHNICAL FIELD

The invention relates to an improved piezoelectric actuated fuel injector which effectively controls fuel metering while maintaining optimum preload on the piezoelectric actuator throughout operation.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection.

In another type of system, such as disclosed in U.S. Pat. No. 5,819,704, the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve.

Internal combustion engine designers have increasingly come to realize that substantially improved fuel supply systems are required in order to meet the ever increasing governmental and regulatory requirements of emissions abatement and increased fuel economy. Specifically, it is well known that improved control of fuel metering, i.e. the rate of fuel flow into the combustion chamber, is essential in reducing the level of emissions generated by the diesel fuel combustion process while minimizing fuel consumption. As a result, many proposals have been made to provide metering, or injection rate, control devices in closed nozzle fuel injector systems.

Piezoelectric devices are desirable for use as valve actuators for several reasons. One being that the devices allow for precise metering and control of small quantities of pressurized fuel. Another desirable feature is that piezoelectric actuators have reliable characteristics when calibrated properly and precisely. However, in a fuel injection valve, the amount of displacement of a piezoelectric element necessary to move the valve element through its valve stroke is very small. Therefore, any slight unintended separation between the piezoelectric elements or layers forming the piezo stack may interfere with effective stack expansion and/or the initial force on the valve thereby possibly adversely affecting fuel injection timing and metering, regardless of the accuracy of the initial calibration. Although piezo stacks are initially preloaded using some mechanism, such as pulling devices, e.g. nut and washer assemblies including a center rod, outer rods and/or outer cages, that pull the ends of the stack toward one another in compression, these preloading device do not provide sufficient preload on the stack throughout operation of the injector.

In addition, establishing an accurate interface between a piezo actuator and movable valve element can be difficult and costly due to small strokes and large forces associated with piezoelectric actuators. Stack-up tolerances due to the assembly of various components also make it difficult to create a match or flush interface between the actuator and valve element. At least one injector manufacturer has produced a piezoelectric injector which uses a hydraulic chamber, between the piezo actuator and the servo injection control valve, filled with low pressure drain fuel to equalize minimal manufacturing tolerances while also compensating for temperature-induced and wear-induced changes in length.

Also, the required size (cross section of the stack) of the piezoelectric elements forming the piezo stack is proportional to the valve opening force. With larger injectors, where the injector needle diameter is larger, a larger size control valve is necessary to reach the desired control chamber pressure dynamic. High opening forces are required to open these larger control valves at high pressures, thereby requiring larger stacks. However, larger piezo stacks are more expensive and less widely available.

U.S. Pat. No. 6,837,221 to Crofts et al. discloses a servo-controlled fuel injector nozzle assembly having feedback control. The injector includes a piezoelectric actuator to actuate a valve member controlling fuel flow from a control volume positioned adjacent one end of a needle valve element to thereby control movement of the needle valve element. This design may not adequately provide preload on the actuator stack throughout operation and does not compensate for thermal expansion, wear and manufacturing tolerances.

Therefore, there is still a need for a simple, improved piezoelectric fuel injector which is capable of maintaining sufficient piezo stack preload throughout operation to ensure effective control over fuel injection.

SUMMARY OF THE INVENTION

It is, therefore, one object of the present invention to overcome the deficiencies of the prior art and to provide a fuel injector nozzle assembly which better enables the engine to meet future diesel engine exhaust emission requirements.

Another object of the present invention is to provide a fuel injector having improved control of fuel metering.

Yet another object of the present invention is to provide a piezoelectric actuated fuel injector having a pressure balanced injection control valve in combination with the ability to hydraulically compensate for thermal and wear induced mechanical variations while maintaining optimum preload on the piezoelectric stack throughout operation.

Still another object of the present invention is to provide a fuel injector having a nozzle assembly capable of compensating for component tolerances and wear, and temperature, which alter the lift characteristics of the nozzle valve.

It is yet another object of the present invention to provide a fuel injector for heavy duty engine applications which can use a more readily available, lower cost piezoelectric stack.

Still another object of the present invention is to provide a fuel injector having a simple, low cost piezo stack preload mechanism.

Yet another object of the present invention is to provide a fuel injector having a simple, low cost mechanism for valve motion amplification.

These and other objects are achieved by providing a fuel injector for injecting fuel at high pressure into the combustion chamber of an engine, comprising an injector body containing an injector cavity and an injector orifice communicating with one end of the injector cavity to discharge fuel into the combustion chamber and a nozzle valve element positioned in one end of the injector cavity adjacent the injector orifice. The nozzle valve element is movable between an open position in which fuel may flow through the injector orifice into the combustion chamber and a closed position in which fuel flow through the injector orifice is blocked. A control volume is positioned to receive a pressurized supply of fuel while a drain circuit is provided for draining fuel from the control volume to a low pressure drain. Also, an injection control valve is positioned along the drain circuit to control fuel flow from the control volume. The injection control valve includes a piezoelectric actuator including a stack of piezoelectric elements movable between expanded and contracted positions and a control valve member movable between an open position permitting flow through the drain circuit and a closed position blocking flow through the drain circuit. In addition, a preload chamber is positioned a spaced axial distance from the control volume between the control volume and the piezoelectric actuator to receive high pressure fluid. Also, a supply of high pressure fluid is connected to the preload chamber, wherein the high pressure fluid in the preload chamber generates a high fluid pressure preload force on the stack of piezoelectric elements. A check valve is also provided which is movable between a closed position to prevent the flow of high pressure fluid from the preload chamber and an open position permitting the flow of high pressure fluid into the preload chamber.

The supply of high pressure fluid may supply high pressure fuel, used for supplying fuel for injection into the combustion chamber of the engine, at a pressure of at least approximately 200 bar. Also, the supply of high pressure fluid may include a high pressure preload supply circuit including an axial passage extending through the control valve member. The control valve member may include a first member and a second member positioned in axial alignment with the first member. The preload chamber may be positioned between the first and the second members. The preload chamber may be formed at least partially in one end of the first member. The preload chamber may be formed at least partially in one end of the second member. The check valve may include a valve element and a bias spring for biasing the valve element toward the closed position. The preload chamber may be formed at least partially in one end of the first member, and the bias spring and the valve element may be at least partially positioned in the preload chamber. Preferably, the injection control valve member is pressure balanced.

The present invention is also directed to a fuel injector for injecting fuel at high pressure into the combustion chamber of an engine, comprising an injector body containing an injector cavity and an injector orifice communicating with one end of the injector cavity to discharge fuel into the combustion chamber and a nozzle valve element positioned in one end of the injector cavity adjacent the injector orifice. The nozzle valve element is movable between an open position in which fuel may flow through the injector orifice into the combustion chamber and a closed position in which fuel flow through the injector orifice is blocked. A control volume is positioned to receive a pressurized supply of fuel while a drain circuit is provided for draining fuel from the control volume to a low pressure drain. Also, an injection control valve is positioned along the drain circuit to control fuel flow from the control volume. The injection control valve includes a piezoelectric actuator including a stack of piezoelectric elements movable between expanded and contracted positions and a control valve member movable between an open position permitting flow through the drain circuit and a closed position blocking flow through the drain circuit. In addition, a preload chamber is positioned a spaced axial distance from the control volume between the control volume and the piezoelectric actuator to receive high pressure fluid. Also, a supply of high pressure fluid is connected to the preload chamber, wherein the high pressure fluid in the preload chamber supplies fuel to the preload chamber at least approximately 200 bar for generating a high fluid pressure preload force on the stack of piezoelectric elements.

A method for providing preload to a piezoelectric actuator of a fuel injector during operation of the injector is also provided which includes providing a fuel injector including a nozzle valve element movable between an open position permitting fuel flow and a closed position blocking fuel flow, a control volume positioned to receive a pressurized supply of fuel, a drain circuit for draining fuel from the control volume to a low pressure drain, an injection control valve including a control valve member positioned along the drain circuit to control fuel flow from the control volume, a piezoelectric actuator including a stack of piezoelectric elements movable between expanded and contracted positions, and a preload chamber positioned a spaced axial distance from the control volume between the control volume and the piezoelectric actuator to receive high pressure fluid. The method also includes supplying high pressure fluid of at least approximately 200 bar to the preload chamber to generate a high fluid pressure preload force on the stack of piezoelectric elements.

DETAILED DESCRIPTION OF THE INVENTION

Figure 1:
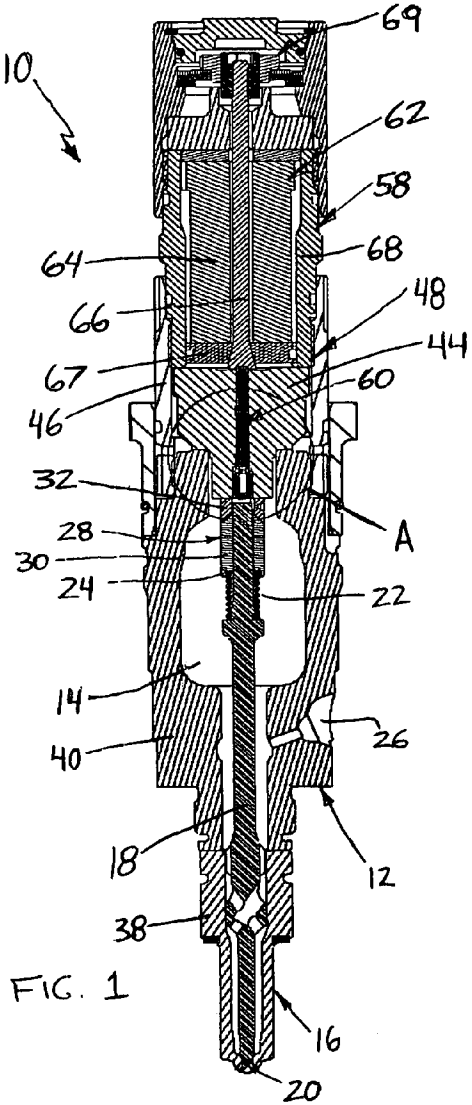
FIG. 1 is a cross sectional view of the fuel injector of the present invention.

Referring to FIG. 1, there is shown a piezoelectric actuated fuel injector of the present invention, indicated generally at 10, which functions to effectively permit accurate and variable control of fuel metering by, in part, providing an improved, high preload on the piezoelectric stack using a simple, reliable, low cost approach. Fuel injector 10 is comprised of an injector body 12 having a generally elongated, cylindrical shape which forms an injector cavity 14. The lower portion of fuel injector body 12 includes a closed nozzle assembly, indicated generally at 16, which includes a nozzle valve element 18 reciprocally mounted for opening and closing injector orifices 20 formed in body 12 thereby controlling the flow of injection fuel into an engine combustion chamber (not shown).

Nozzle valve element 18 is preferably formed from a single integral piece structure and positioned in one end of injector cavity 14. A bias spring 22 is positioned in injector cavity 14 for abutment against a land 24 formed on nozzle valve element 18 so as to bias nozzle valve element 18 into a closed position as shown in FIG. 1. A high pressure fuel supply passage 26 is formed in injector body 12 for supplying high pressure fuel from a high pressure source to injector cavity 14. The upper end of nozzle valve element 18 is positioned for slideable movement within a sealing and guide sleeve 28. Sealing and guide sleeve 28 includes a first section 30 and a second section 32 positioned in abutment against first section 30. A lower end of first section 30 is positioned for abutment by the upper end of bias spring 22 while the upper end of first section 30 abuts second section 32 so as to maintain the upper end of second section 32 in sealing abutment against injector body 12.

As shown on FIG. 1, injector body 12 includes a nozzle housing 38 for receiving a lower end of nozzle valve element 18, a barrel 40 for receiving the upper end of nozzle valve element 18, and a retainer (See retainer 42 in FIG. 5) containing internal threads for engaging corresponding external threads on the lower end of barrel 40 to permit the components to be held together in compressive abutting relationship by simple relative rotation of retainer 42 with respect to barrel 40. Fuel injector 10 further includes a nozzle valve control arrangement indicated generally at 48 for controlling the movement of nozzle element 18 between open and closed positions so as to define an injection event during which fuel flows through injector orifices 20 into the combustion chamber. Specifically, nozzle valve control arrangement 48 operates to initiate the beginning of movement of nozzle valve element 18 from one of its positions to the other while also preferably variably controlling the movement, i.e., rate of movement of nozzle valve element 20 as it moves between open and closed positions and the degree of opening of the nozzle valve element. In this manner, nozzle valve control arrangement 48 functions to control the quantity of fuel metered and also preferably as a rate shaping control device so as to improve combustion and minimize emissions.

The nozzle assembly of the present invention can be adapted for use with a variety of injectors and fuel systems. For example, closed nozzle injector 10 may receive high pressure fuel from a high pressure common rail or, alternatively, a pump-line-nozzle system or a unit injector system incorporating, for example, a mechanically actuated plunger into the injector body. Thus, the nozzle assembly of the present invention may be incorporated into any fuel injector or fuel system which supplies high pressure fuel to the injector while permitting nozzle valve control arrangement 48 to control the timing, quantity, and, preferably, rate shape of the fuel injected into the combustion chamber. As most clearly shown in FIGS. 1 and 2, nozzle control arrangement 48 includes a control volume or cavity 50 formed at the outer end of sealing and guide sleeve 28 and a control charge circuit 54 for directing fuel from supply passage 26 into control volume 50. Nozzle valve control arrangement 48 further includes a drain circuit 56 for draining fuel from control volume 50 and an injection control valve 58 positioned along drain circuit 56 for variably controlling the flow of fuel through drain circuit 56 so as to cause controlled, predetermined movement of nozzle valve element 18.

Injection control valve 58 is specifically designed to enable precise control over the movement of nozzle valve element 18 from its closed to its open position so as to predictably control the flow of fuel through injector orifices 20 for achieving a desired fuel metering and, preferably, injection rate change. As shown in FIG. 1, injection control valve 58 includes a control valve member 60 and a piezoelectric actuator 62 for selectively moving control valve member 60, e.g. through a predetermined variable lift schedule, upon actuation to precisely control the movement of nozzle valve element 18. Piezoelectric actuator 62 includes a columnar laminated body, or stack, of thin disk-shaped elements 64 each having a piezoelectric effect, a control rod 66 and an actuator housing 68. When a voltage, i.e, +150 volts, is applied to each element, the element expands along the axial direction of the column. Conversely, when a voltage of −150 volts is applied to each element, the element contracts so that the inner end of piezoelectric actuator 62 moves away from closed nozzle assembly 16. The lower end of control rod 66 abuts the upper end of control valve member 60 so that the expansion/contraction of piezoelectric actuator 62 is directly transmitted to control valve member 60 causing control valve member 60 to move between open and closed positions. The inner end of control rod 66 extends through a stack washer 67 and is initially set to pull the washer 67 and stack 64 in compression via a conventional adjustable preload assembly 69 mounted on the outer end of control rod 66. Piezoelectric actuator 62 may include any type or design of piezoelectric actuator capable of actuating control valve 58 as described hereinbelow.

It should be noted that the actuation/de-actuation of actuator 62 is controlled by a control device (not shown), i.e., an electronic control unit, which precisely controls the timing of injection by providing an injection control signal to actuator 62 at a predetermined time during engine operation, the fuel metering by controlling the duration of the injection control signal and, preferably, also the injection rate shape by controllably varying the voltage supply to actuator 62 based on engine operating conditions.

Injection control valve 58 further includes a valve support 44 positioned at the outer end of barrel 40 and a connector sleeve 46 for securing valve support 44 to barrel 40. Specifically, connector sleeve 46 of injector body 12 contains internal threads at a lower end for engaging complementary external threads formed on barrel 40 and contains internal threads at an upper end for engaging external threads formed on actuator housing 68 so that rotation of connector sleeve 46 can be used to connect actuator housing 68 and thus injection control valve 58 to injector body 12 while securing valve support 44 to barrel 40. A valve seat 70 is formed on valve support 44 along drain circuit 56 a spaced distance from control volume 50 for abutment by control valve member 60. Control valve member 60 includes an inner valve member 71 and an outer valve member 73. Inner control valve member 71 includes an inner end positioned adjacent the outer end of nozzle valve element 18 to form an end wall of control volume 50. Inner valve member 71 may be formed from a single piece of material or may include a first section 76 and second section 78 positioned in abutment against first section 76. An annular valve surface 77 formed on second section 78 moves between an open position spaced from valve seat 70 to permit fuel flow to drain and a closed position sealingly abutting valve seat 70 to block flow to drain. Outer valve member 73 includes an outer end positioned in abutment against control rod 66 and an inner end positioned adjacent the outer end of inner valve member 71. A preload chamber 75 is positioned between inner valve member 71 and outer valve member 73 for receiving high pressure fluid, i.e. fuel, so as to apply a fluid pressure induced preload force on the piezoelectric stack 64.

Drain circuit 56 is formed in control valve member 60 and includes a central passage 80 formed in first section 76 and second section 78. Preferably, central passage 80 includes a drain orifice 82 designed with a larger cross sectional flow area than a similar orifice formed in control volume charge circuit 54 to cause a greater amount of fuel to be drained from control volume 50 than is replenished via control volume charge circuit 54 upon opening of injection control valve 58 as discussed hereinbelow. Drain circuit 56 also includes one or more transverse passages 84 extending from central passage 80 to communicate with an annular cavity 86 positioned upstream from valve seat 70. Thus, when control valve member 60 moves into an open position, fuel from control volume 50 flows through central passage 80 and transfer passages 84 into annular cavity 86 and through the valve opening at valve seat 70 onward to a low pressure drain via drain passages 99. The low pressure drain passages extending through injector body 12 are more completely shown in FIG. 4.

As noted above, the fuel injector of the present invention includes a preload chamber 75 formed along the injector between control volume 50 and the stack of piezo elements 64. In the present embodiment, preload chamber 75 is advantageously positioned between inner valve member 71 and outer valve member 73 of injection control valve member 60. Preload chamber 75 functions to apply a high preload force to piezoelectric stack 64 throughout operation of the injector including both during and between injection events. A check valve 90 is positioned in preload chamber 75 to control the flow of fuel from central passage 80 into preload chamber 75. Preferably, check valve 90 is lightly biased toward the closed position by a coil spring 92. The inner end of check valve 90 includes a flat valve surface which sealingly abuts the outer end of second section 78 when check valve 90 is in the closed position. In the present embodiment, check valve 90 is positioned in a cavity 94 formed in the inner end of outer valve member 73. An annular recess 96 may be formed on the inner surface of valve support 44 adjacent the preload chamber 75. Importantly, high pressure fuel is fed into preload chamber 75 to ensure a high pressure is maintained in preload chamber 75 so that sufficiently high preload is maintained on the stack of piezo elements 64. In the present embodiment, a high pressure supply passage 98 extends axially through second section 78 of inner valve member 71 from central drain passage 80 thereby providing a direct route for high pressure fuel without requiring additional structural interfaces thereby avoiding costs of sealing and minimizing potential leakage. High pressure fuel delivered to preload chamber 75 creates a hydraulic link, as discussed more fully hereinbelow, which effectively maintains a preload on the stack of piezo elements 64 by applying fluid pressure forces on outer valve member 73 which in turn applies a force on control rod 66 and washer 67, thereby ensuring the stack of elements 64 are maintained in compression throughout injector operation.

Figure 3:
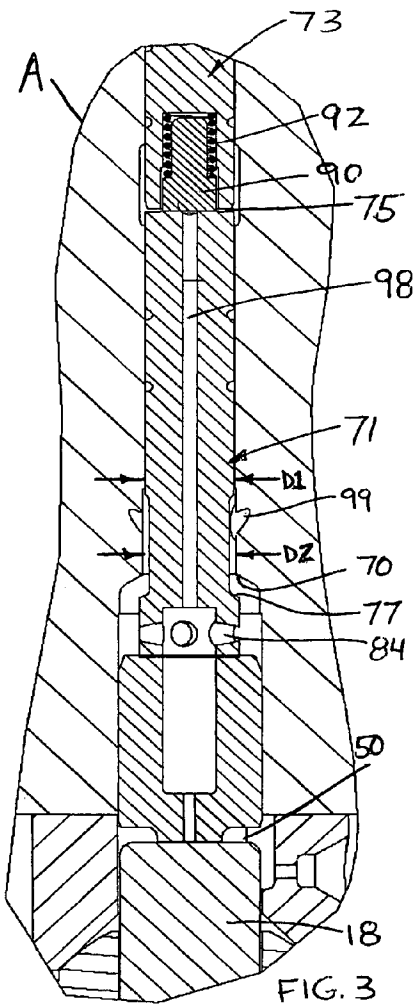
FIG. 3 is an expanded cross sectional view of area A in FIG. 1 with the piezoelectric actuator actuated (piezo force applied) and the control valve in the open position.

The fuel injector of the present invention also includes a substantially pressure balanced injection control valve member 60 which minimizes the piezoelectric force required to move injection control member 60 from the closed position to the open position. As shown in FIG. 3, the fluid pressure forces acting on injection control valve member 60 are substantially balanced by forming second section 78 of inner valve member 71 with a slightly smaller diameter D1 than the diameter D2 of valve seat 70. In this manner, the developing pressure forces on second section 78 tending to move second section 78 toward an open position, for example due to the fluid pressure in preload chamber 75, is only slightly less than the fluid pressure forces tending to close injection control valve member 60 resulting in a minimum, but sufficient positive, closing force on injection control valve member 60.

Figure 2:
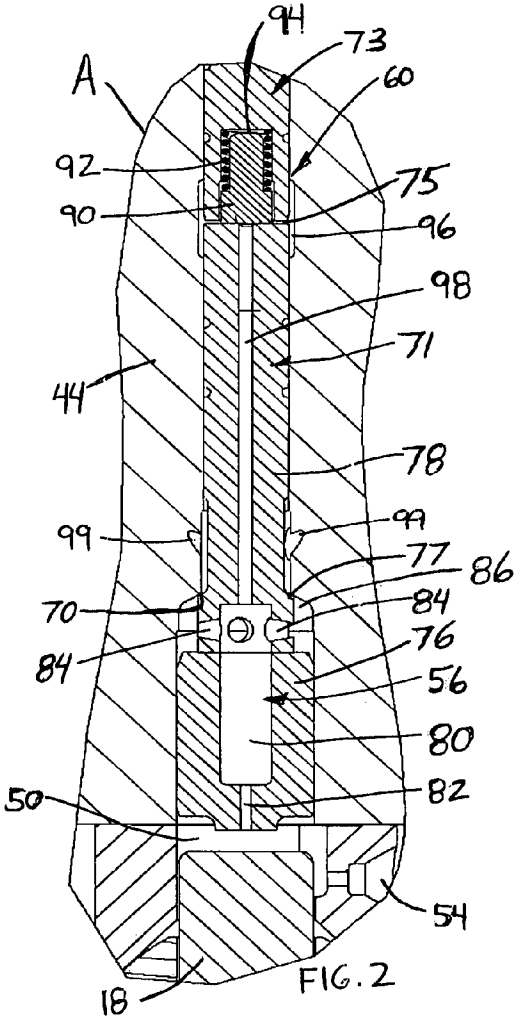
FIG. 2 is an expanded cross sectional view of the area A in FIG. 1 with the piezoelectric actuator deactuated (no piezo force) and the control valve in the closed position.

The advantages of the present invention can be more fully appreciated from the following description of the operation of fuel injector 10. Referring to FIGS. 1–2, during operation, prior to an injection event, injection control valve 58 is de-energized causing control valve member 60 to be biased into the closed position in sealing engagement against valve seat 70 by fuel pressure forces acting on the inner distal end of control valve member 60 due to the high pressure fuel in control volume 50. The fuel pressure level experienced in the injector cavity surrounding nozzle valve element 18 is also control volume drain circuit 56 including annular volume 86, since drain flow through drain circuit 56 is blocked by control valve member 60. As a result, the fuel pressure acting inwardly on nozzle valve element 18, in combination with the bias force of spring 22, maintain nozzle valve element 18 in its closed position blocking flow through injector orifices 20. In this state, preload chamber 75 is also filled with the high pressure fuel at the same level as the control volume 50. The annular cavity 86 provides a sufficient quantity of fuel to ensure preload chamber 75 is filled with high pressure fuel. Although leakage of fuel from preload chamber 75 may occur through the clearance gap between the valve members 71, 73 and the opposing bore surfaces, check valve 90 permits fuel to flow into preload chamber 75 as needed to maintain preload chamber at high pressure, thereby maintaining a high preload force on the stack of piezo elements 64. Moreover, leakage of high pressure fuel from preload chamber 75 along the valve members 71, 73 can be minimized by match fitting the members to the corresponding to create a substantial fluid seal between the surfaces while permitting smooth sliding movement of control valve member 60. As a result, preload chamber 75 maintains a sufficiently high preload force on the piezoelectric stack 64 between injection events.

At a predetermined time during the supply of high pressure fuel to high pressure fuel supply passage 26, piezoelectric actuator 62 is energized causing the stack of elements 64 to expand and move control rod 66 inwardly thus controllably moving outer valve member 73 causing check valve 90 to close. As a result, the movement of outer valve member 73 is transmitted to inner valve member 71 via the hydraulic link formed by the fuel in preload chamber 75. Inner valve member 71 thus moves from the closed position of FIG. 2 to the open position of FIG. 3. Opening of the injection control valve member 60 causes the pressure in drain circuit 54, including central passage 80 and annular cavity 86, and thus high pressure fuel supply passage 98, to decrease. The pressure differential between high pressure fuel supply passage 98 and the higher pressure preload chamber 75 causes check valve 90 to be maintained in a closed position blocking fuel flow into preload chamber 75 during an injection event. Thus, as control valve member 60 is lifted from valve seat 70, fuel flows from control volume 50 through drain circuit 56 to the low pressure drain. Simultaneously, high pressure fuel flows from control volume charge circuit 54 and the associated orifice into control volume 50. However, since the control volume charge circuit orifice is designed with a smaller cross sectional flow area than drain orifice 82, a greater amount of fuel is drained from control volume 50 than is replenished via control volume charge circuit 54. As a result, the pressure in control volume 50 immediately decreases. As a result of the decreasing control volume pressure, fuel pressure forces acting on nozzle valve element 18 due to high pressure fuel in injector cavity 14, begin to move nozzle valve element 18 outwardly against the bias force of spring 22. Nozzle valve element 18 continues its outward movement until it reaches a hovering position in close proximity to, but without contacting, the inner distal end of control valve member 60 as shown in FIG. 3. Importantly, during injection events, with the pressure in control volume 50 at lower pressure, preload chamber 75 is maintained at relatively high pressure by closing of the check valve thereby advantageously maintaining a high preload force on the piezoelectric stack 64 compared to prior designs.

After a predetermined time has passed, the control unit (not shown) sends a signal causing the de-actuation of piezoactuator 62 which results in the contraction of the piezoelectric stack of elements 64. This enables fuel pressure forces to move inner valve member 71 and outer valve member 73 outwardly in the closing direction until contacting the valve seat 70 in the closed position. At the beginning of this closing stroke/phase, the hydraulic link in preload chamber 75 is shorter in axial length due to the previously mentioned leakage in the clearance gap along the valve members 71, 73, thereby advantageously resulting in a more definite valve closing. However, leakage from preload chamber 75 is insufficient during the actuator on-time period to completely collapse the hydraulic link in preload chamber 75 and thus outer valve member 73 does not contact inner valve member 71. Once in the closed position, fuel pressure again increases in control volume 50, drain circuit 56 upstream of valve seat 70, high pressure supply passage 98 and preload chamber 75 as high pressure fuel flows through check valve 90 into preload chamber 75 expanding/lengthening the hydraulic link.

Figure 7:
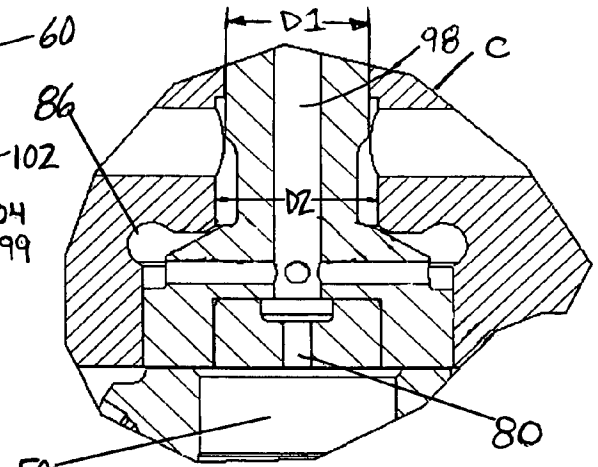
FIG. 7 is an expanded cross sectional view of the area C in FIG. 6.
Figure 6:
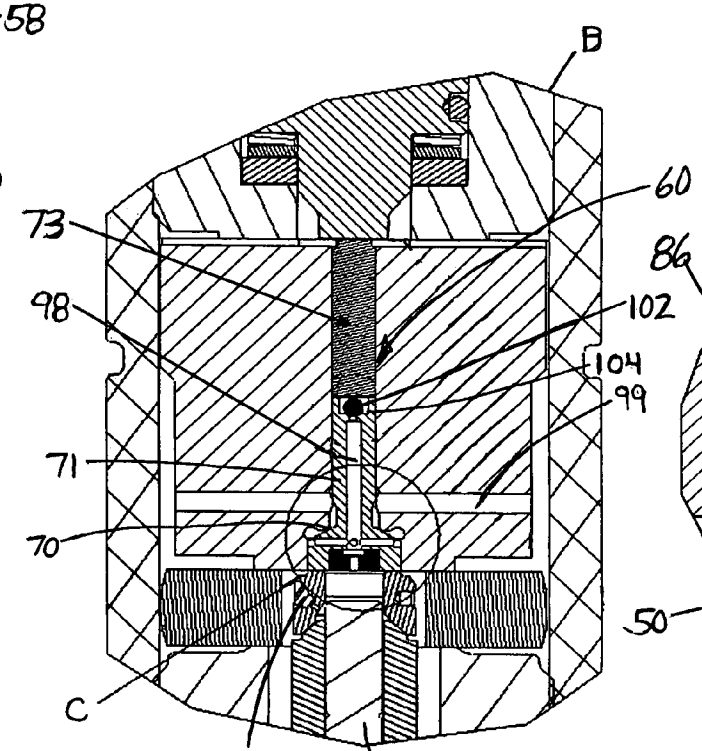
FIG. 6 is an expanded cross sectional view of the area B in FIG. 5.
Figure 5:
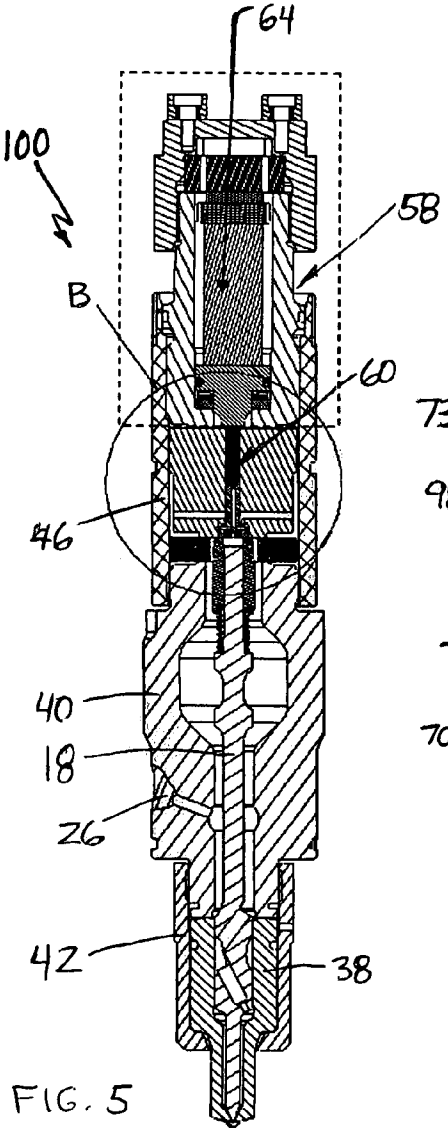
FIG. 5 is a cross sectional view of a second embodiment of the fuel injector of the present invention

Now referring to FIGS. 5–7, a second embodiment of the fuel injector of the present invention is shown which is essentially the same as the previous embodiment except for various features and components including slightly different designs and shapes but functions the same as the previous embodiment. In this respect, the same or similar components will be referred to with the same reference numerals used in the previous embodiment. It should be noted that in the present embodiment, however, a fuel injector 100 includes a check valve 102 is positioned in a cavity 104 formed in the outer end of inner valve member 71 unlike the previous embodiment. Moreover, check valve 102 is not spring biased as shown but, of course, a coil spring or other biasing element may be provided.

Figure 4:
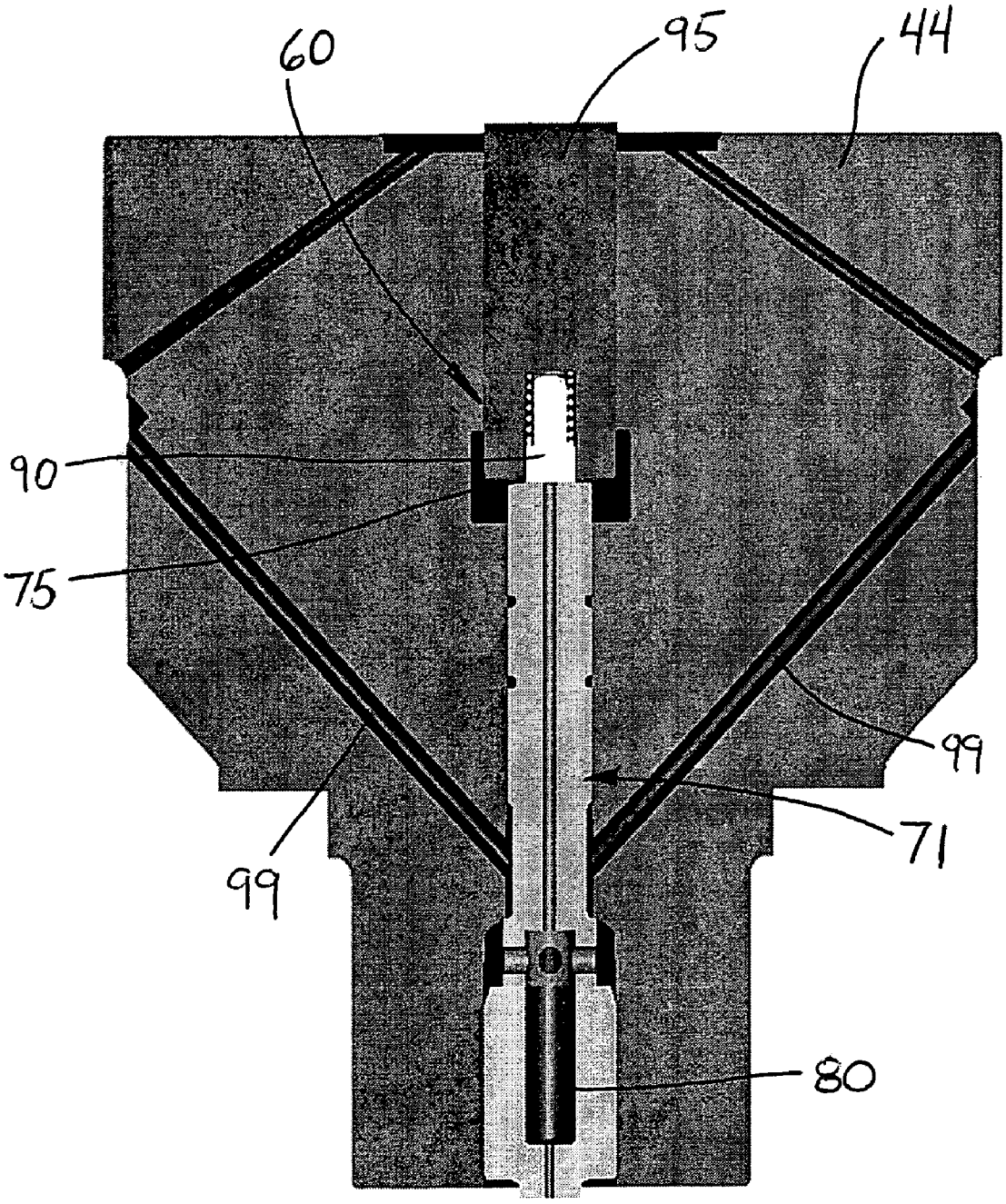
FIG. 4 is an expanded cross sectional of a portion of an injector similar to the injector of FIG. 1 except with pressure amplification.

The present invention has several advantages over existing injector designs. While conventional prior designs use a complicated mechanical preload device for maintaining a preload on the piezo stack of elements during operation, the fuel injector of the present invention uses a simple, low-cost hydraulic link positioned within the injection control valve and readily available high pressure fuel to create the necessary preload forces on the stack. Also, the fuel injector of the present invention provides a substantially pressure balanced injection control valve member 60 which minimizes the amount of force required to move injection control valve member 60 to an open position against the fuel pressure forces tending to close valve member 60. Consequently, a smaller stack of piezo elements 64 may be used in the injector for effective operation, especially in heavy duty engine applications typically requiring larger piezo stacks to create greater opening forces. For example, a piezo stack sized for, and typically used in, injectors for automobile applications can be used with the injection control valve 58 of the fuel injector of the present invention as sized for heavy duty engine applications. The preload chamber 75 of the present invention also solves thermal expansion issues without using special materials or any other compensation technology since the hydraulic link created by preload chamber 75 expands as needed to compensate for thermal expansion of the valve members and other components. Thus, the hydraulic link also compensates for mechanical variations due to wear of the components during operation. Further, the present invention permits a simple implementation of control valve motion amplification without mechanical levers or any other mechanical methods, thereby increasing the valve opening force and improving the system dynamic. For example, as shown in FIG. 4, an outer valve member 95 may be formed with a larger diameter than the diameter of inner valve member 71 which increases the force on the hydraulic link in preload chamber 75 thereby increasing the force on inner valve member 71. The motion will be amplified proportional to the ratio of the area of the two valve members.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection control by a simple control device in order to minimize emissions. Such internal combustion engines including a fuel injector in accordance with the present invention can be widely used in all industrial fields, commercial and noncommercial applications, including trucks, passenger cars, industrial equipment, stationary power plants and others.

We claim:

1. A method for providing preload to a piezoelectric actuator of a fuel injector during operation of the injector, comprising:

providing a fuel injector including a nozzle valve element movable between an open position permitting fuel flow and a closed position blocking fuel flow, a control volume positioned to receive a pressurized supply of fuel, a drain circuit for draining fuel from said control volume to a low pressure drain, an injection control valve including a control valve member positioned along said drain circuit to control fuel flow from said control volume, a piezoelectric actuator including a stack of piezoelectric elements movable between expanded and contracted positions, and a preload chamber positioned a spaced axial distance from said control volume between said control volume and said piezoelectric actuator to receive high pressure fluid; and supplying high pressure fluid of at least approximately 200 bar to said preload chamber to generate a high fluid pressure preload force on said stack of piezoelectric elements.

2. A fuel injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain;

an injection control valve positioned along said drain circuit to control fuel flow from said control volume, said injection control valve including a piezoelectric actuator including a stack of piezoelectric elements movable between expanded and contracted positions and a control valve member movable between an open position permitting flow through said drain circuit and a closed position blocking flow through said drain circuit;

a preload chamber positioned a spaced axial distance from said control volume between said control volume and said piezoelectric actuator to receive high pressure fluid;

a supply of high pressure fluid connected to said preload chamber, wherein the high pressure fluid in said preload chamber generates a high fluid pressure preload force on said stack of piezoelectric elements; and a check valve movable between a closed position to prevent the flow of high pressure fluid from said preload chamber and an open position permitting the flow of high pressure fluid into the preload chamber.

3. The injector of claim 2, wherein said supply of high pressure fluid supplies high pressure fuel, used for supplying fuel for injection into the combustion chamber of the engine, at a pressure of at least approximately 200 bar.

4. The injector of claim 2, wherein said supply of high pressure fluid includes a high pressure preload supply circuit including an axial passage extending through said control valve member.

5. The injector of claim 2, wherein said injection control valve member is pressure balanced.

6. The injector of claim 2, wherein said check valve includes a valve element and a bias spring for biasing said valve element toward said closed position.

7. The injector of claim 6, wherein said preload chamber is formed at least partially in one end of said first member, said bias spring and said valve element being at least partially positioned in said preload chamber.

8. The injector of claim 2, wherein said control valve member includes a first member and a second member positioned in axial alignment with said first member, said preload chamber positioned between said first and said second members.

9. The injector of claim 8, wherein said preload chamber is formed at least partially in one end of said first member.

10. The injector of claim 8, wherein said preload chamber is formed at least partially in one end of said second member.

11. A fuel injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain;

an injection control valve positioned along said drain circuit to control fuel flow from said control volume, said injection control valve including a piezoelectric actuator including a stack of piezoelectric elements movable between expanded and contracted positions and a control valve member movable between an open position permitting flow through said drain circuit and a closed position blocking flow through said drain circuit;

a preload chamber positioned a spaced axial distance from said control volume between said control volume and said piezoelectric actuator to receive high pressure fluid; and a supply of high pressure fluid connected to said preload chamber to supply fluid at a pressure of at least approximately 200 bar, wherein the high pressure fluid in said preload chamber generates a high fluid pressure preload force on said stack of piezoelectric elements.

12. The injector of claim 11, wherein said supply of high pressure fluid is a supply of high pressure fuel used for supplying fuel for injection into the combustion chamber of the engine.

13. The injector of claim 11, further including a check valve movable between a closed position to prevent the flow of high pressure fluid from said preload chamber and an open position permitting the flow of high pressure fluid into the preload chamber.

14. The injector of claim 11, wherein said supply of high pressure fluid includes a high pressure preload supply circuit including an axial passage extending through said control valve member.

15. The injector of claim 11, wherein said injection control valve member is pressure balanced.

16. The injector of claim 11, wherein said check valve includes a valve element and a bias spring for biasing said valve element toward said closed position.

17. The injector of claim 16, wherein said preload chamber is formed at least partially in one end of said first member, said bias spring and said valve element being at least partially positioned in said preload chamber.

18. The injector of claim 11, wherein said control valve member includes a first member and a second member positioned in axial alignment with said first member, said preload chamber positioned between said first and said second members.

19. The injector of claim 18, wherein said preload chamber is formed at least partially in one end of said first member.

20. The injector of claim 18, wherein said preload chamber is formed at least partially in one end of said second member.

* * * * *